United States Patent [19]

Smith

[11] Patent Number: 4,944,053

[45] Date of Patent: Jul. 31, 1990

[54] FABRIC DEVICE IN COMBINATION WITH A BED, RESTING SURFACE OR EXAMINING TABLE FOR FACILITATING USER TURNING AND PATIENT EXAMINATIONS

[76] Inventor: Mary E. Smith, 180 Arlington Ave., Hawthorne, N.J. 07506

[21] Appl. No.: 392,191

[22] Filed: Aug. 10, 1989

Related U.S. Application Data

[63] Continuation-in-part of Ser. No. 94,331, Sep. 8, 1987, abandoned.

[51] Int. Cl.[5] ..... A61G 7/10

[52] U.S. Cl. ..... 5/61; 5/81 B; 5/502

[58] Field of Search ..... 5/61, 81 R, 81 C, 89, 5/484, 487, 502

[56] References Cited

U.S. PATENT DOCUMENTS

| | | | |
|---|---|---|---|
| 274,690 | 3/1883 | Willey | 5/487 |
| 3,769,642 | 11/1973 | Warman | 5/81 B |
| 3,849,813 | 11/1979 | Neilson | 5/482 X |
| 4,051,565 | 10/1977 | Berge | 5/81 B |

FOREIGN PATENT DOCUMENTS

| | | | |
|---|---|---|---|
| 1007768 | 3/1977 | Canada | 5/81 B |

*Primary Examiner*—Michael F. Trettel
*Attorney, Agent, or Firm*—W. Patrick Quast

[57] ABSTRACT

A fabric device useful in facilitating the movement of a person's body while lying on a bed, resting surface, examining table or the like. The fabric device comprises a first fabric made from a non-woven material similar to HANDI-WIPE material. This first fabric is secured to an identically sized and shaped second fabric of relatively frictionless material such as woven, synthetic material or even a plastic sheet.

Two such fabric devices can be utilized in combination with an OB/GYN physician's examining table, bed or other resting surface. A first fabric device is positioned on the table or bed with the non-woven material face down and secured to the table top if it would slip thereon. The second fabric device is positioned with its frictionless material contacting the frictionless material of the first fabric device. For the examining table, application, typically the examining paper would then be interposed between the patient's body and the non-woven material of the second fabric device. The interfacing frictionless materials facilitate patient movement along the length of the table or rotating movement on the bed or resting surface. Also, the combined fabric can be seamed end to end so as to form a tube with the second fabric of relatively frictionless material facing inwardly. In combination with a bed or resting surface, the combined fabric device(s) would be of sufficient length and width to extend across a portion of the bed, and typically from the mid-back to thigh area of the person reclining thereon.

The first fabric can be diagonally stitched along a plurality of locations along the length to provide stability and increase wear.

10 Claims, 3 Drawing Sheets

FABRIC DEVICE IN COMBINATION WITH A BED, RESTING SURFACE OR EXAMINING TABLE FOR FACILITATING USER TURNING AND PATIENT EXAMINATIONS

This is a continuation in part application of U.S. Ser No. 07/094,331 which was filed on Sept. 8, 1987 and which is now abandoned.

FIELD OF THE INVENTION

This invention relates generally to devices which facilitate the movement, including turning, of people reclining on resting surfaces, and particularly to devices which facilitate movement, while reclining, of physically debilitated people, be they in a hospital at a physician's office, or at home.

BACKGROUND OF THE INVENTION

Persons who are bed ridden for long periods of time, especially the elderly, run serious risks of pneumonia and other diseases due to inactivity and lying in a supine position (flat on the back) for prolonged intervals. Nursing staffs attempt to alleviate these problems by positioning patients on their sides at least a portion of the time. However, many patients are too weak to roll over themselves.

In addition, people, be they patients in a hospital, or otherwise resting at home, suffer from various ailments including arthritis and back conditions, where shifting on a bed or other resting surface, from a supine to a position on one's side, results in severe pain. This is attributable in part to the force needed to be exerted by the person to overcome the frictional engagement between the body and clothing with the covering surface of the bed or other resting surface. Devices which facilitate repositioning patients are disclosed generally in prior patents.

For example, U.S. Pat. No. 4,536,903, describes a fabric device including hand grip means extending laterally outward from each side. Either hand grip means is disposed over the torso of the patient and engages the bed side rail to facilitate turning and holding of the patient on his side.

U.S. Pat. No. 4,109,329, describes a complex device comprising a bed or similar device which includes a loop of flexible material wide enough to hold the supine patient. The loop of material is driveable in the loop direction so that the patient moves in the loop direction.

Another type of relatively complex design that has been used to turn a patient and support him is disclosed in U.S. Pat. No. 3,895,403.

Still other configurations have been developed which facilitate transfer of relatively immobile persons, either longitudinally while on a resting surface; or transversely from one surface to another. Disclosure of such devices are contained in Canadian Patent No. 1,007,768 issued to Clara A. Treat, on Mar. 29, 1977, for a device facilitating patient positioning in a longitudinal direction; and, also, in U.S. Pat. No. 4,051,565 which facilitates patient transfer from a first surface such as a transport table, to a second surface, such as a bed. Some of the devices disclosed are relatively complex and are for patients who are incapacitated, and as a result require the assistance of other individuals to accomplish their purpose.

In many circumstances, although perhaps suffering from a pain-debilitating affliction, the user retains the strength and dexterity to effect his own movement. It would be desirable to provide such a person with a device which would facilitate, primarily, the turning movement; and, which would allow the user to do so with minimal effect on his condition.

Such a device, if it were to be disposed about and in contact with the user of course should not contribute to his discomfort if at all possible both during any movement; and if it is to be disposed beneath the user, while at rest, for an extended period of time.

Further, since such a device could be helpful both at home and in a patient care facility, it would be desirable that the cost be within an individual's means.

Beyond the benefits for a user who may be experiencing debilitating pain, certainly to the extent the device could have broader application, say for example by gynecologists or other physicians during their examining procedure, it would be desirable.

It is therefore a primary object of the present invention to provide a simple fabric device which facilitates the turning of patients, in most cases by themselves.

Another object is to provide a low cost device which employs materials presently available on the market; and, presently used extensively in hospital and other health care facilities.

It is yet another object of this device to provide a product, which because of its relatively low cost, is disposable thereby avoiding the expense of laundering; and minimizing possible, attending health concerns through handling.

Still another object of the present invention is to permit patient turning, and still have the patient remain in the middle of the bed and not move dangerously close to the edge.

It is still another object of this invention to provide a device which does not contribute to user discomfort.

And it is still another object of this invention that it have further application in physician's examining offices, primarily gynecologists, where it provides patient comfort and facilitates the examination procedure.

SUMMARY OF THE INVENTION

A fabric device useful in facilitating the movement of a person's body while lying on a bed or the like. The fabric device comprises a first fabric made from a non-woven material similar to HANDI-WIPE material, which absorbs moisture and which is also air and water permeable. This first fabric is secured to an identically sized and shaped second fabric of relatively frictionless material such as woven, synthetic material or even a plastic sheet. The combined fabric can be used without further assembly in combination with an OB/GYN physician's examining table. In combination with the examining table a first fabric device including the first fabric secured to the second fabric is positioned on the examining table with the first fabric material face down and typically secured to the table top. A second fabric device substantially identical to the first fabric device including a non-woven third fabric secured to a fourth relatively frictionless fabric of woven synthetic material or plastic is positioned over the first fabric device with the fourth fabric of the second fabric device face down and in contact with the second fabric of the first fabric device. Typically the examining paper is placed on top of the non-woven third fabric of the second fabric device.

In a further embodiment, the first and second fabric devices described, can be disposed transversely across a resting surface such as the user's bed and in combination therewith. In this embodiment the first fabric device is somewhat wider than the user's body and is disposed upon the resting surface with the first fabric contacting the bed sheet, for example. The first fabric device may or may not be secured to the resting surface, depending on the material, if any, covering the resting surface. The second fabric device extends in length, longer than the first fabric device. For use with a bed, the second fabric device may extend the width of the bed, and perhaps, drape a few inches over on either side. Again the fourth fabric (of the second fabric device) contacts the second fabric (of the first fabric device) to permit ease of movement of the second device in relation to the first. The material width, i.e. as it is disposed along the longitudinal length of the bed or resting surface, would extend the distance between the person's mid-back to his thighs. This is where the person would position the combined first and second fabric devices so as to facilitate his turning or other movement.

Alternatively the combined fabric can be seamed end to end so as to form a tube with the second fabric of relatively frictionless material facing inwardly. In combination with a bed, this would be of sufficient length to extend beyond the user's body when in a supine position; and, width to extend longitudinally along a portion of the bed, again, so that it extends typically from mid-back to thigh area of the person reclining thereon.

The first fabric is typically loosely stitched to the second fabric at a plurality of locations along the length. Periodic stitching, such as diagonal stitching, can be used to provide stability and increase wear. In joining the two, it is important not to "seal off" the first fabric by applying the second fabric thereto by adhesive means or the like which would inhibit the "breathing" ability, both as to moisture and air, of the first fabric material. This aids in the user comfort. Also, the thinness and compactness of the materials selected alleviate a cause for discomfort if the fabric device should bunch up beneath the person during use. The thinness and compactability also permit easy folding and storage.

BRIEF DESCRIPTION OF THE DRAWINGS

A brief understanding of the invention, its objects and advantages may be obtained by a study of the accompanying drawings in which.

DESCRIPTION OF THE PREFERRED EMBODIMENTS

Figure 1:
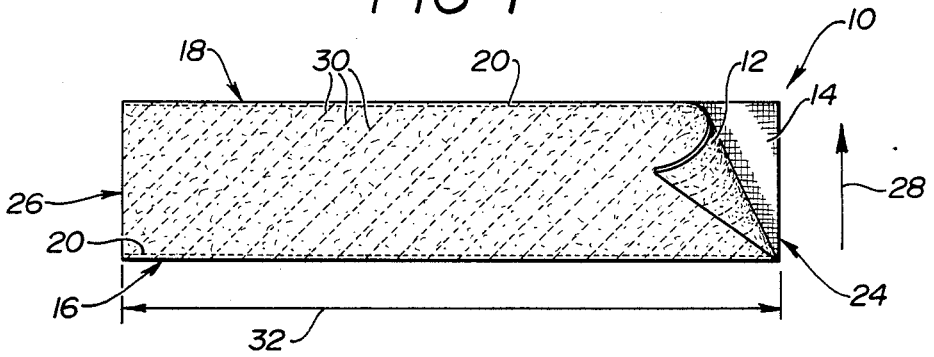
FIG. 1 is an elevation view of the fabric device of the present invention.

Referring to FIG. 1, the fabric device 10 of the present invention is seen to comprise a first fabric 12 joined to a second fabric 14 along edges 16 and 18. For example, stitching 20.

First fabric 12 is a non-woven material similar to that employed by the Colgate-Palmolive Co. in its trade marked product HANDI-WIPES. The Kendall Co. of Boston, Massachusetts supplies this material to companies such as its parent Colgate-Palmolive Co. Kendall's product numbers for non-woven material used by applicant are its #14-6044 and SP 283-7available from its non-woven fabric group in Athens, Ga. It is a porous material permeable to air and water which is soft and pliable and typically non-irritating to the skin. It is also moisture absorbent. It is easily folded and compacted which permits ready storage of the fabric device for subsequent use.

The second fabric, 14, typically a woven, synthetic material which is relatively frictionless when rubbed against itself. For example, a polyester sheer, nylon curtain fabric has been used by the applicant. However, to further reduce the cost, the second fabric can be a "slippery" plastic sheet material. The second fabric material is also thin and pliable to permit easy folding of the fabric device.

The second fabric, 14, if woven material is used, would be cut from the bolt of that material cross wise to the direction the material unravels from the bolt. These edges 24 and 26 would be the selvage of the woven material on the bolt so that the warp of the woven material runs in the direction of arrow 28.

First fabric 12 is fixedly secured to second fabric 14, as for example by a plurality of stitchings 30, typically repeated over the length of the combined material, 32. The periodic stitching, as for example the diagonal stitching shown, adds strength and stability to the first fabric, i.e. prevents unnecessary wear and ruffling as the patient turns on the material. This increases the life of the fabric device.

The first fabric is aligned with the second fabric so that the non-woven pattern axially aligns with the warp and woof of the woven material before the two are fixedly attached. In securing the two it is important to maintain an air space between them. This permits air to permeate and circulate through the first fabric; and to allow sweat to pass through, so that the user's comfort is enhanced.

Figure 2:
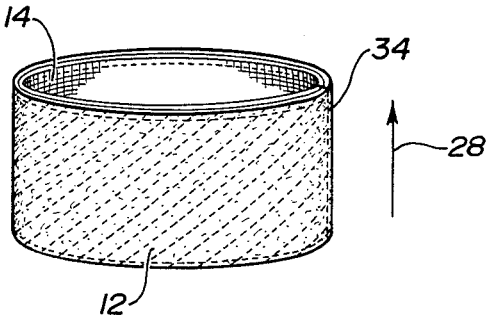
FIG. 2 is a perspective view of one embodiment of the present invention.
Figure 3:
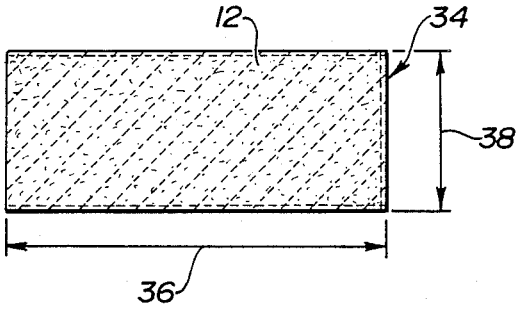
FIG. 3 is an elevation view of the embodiment of FIG. 2.
Figure 4:
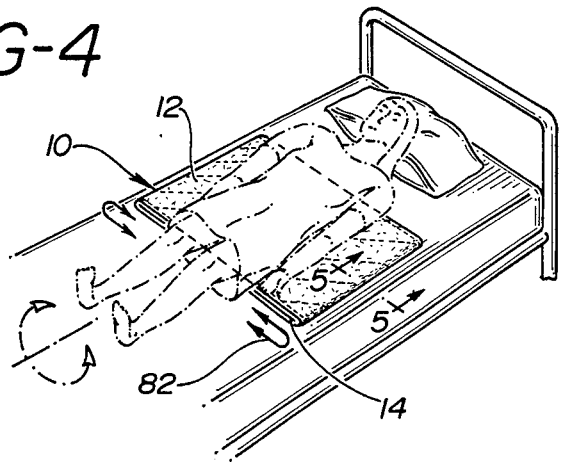
FIG. 4 is a perspective view of the embodiment of FIG. 2 disposed beneath a person reclining on a bed.

FIGS. 2,3,4 and 5 depict one embodiment of the invention. Edges 24 and 26 are brought together and a seam 34 is taken in the direction 28. The second fabric 14 is on the interior of the tube as best perceived from FIG. 2. FIG. 3 shows the seamed, fabric device in an elevation view. As seen in FIG. 4, length 36 is sufficient to cover a user's bed from side to side; and length 38, approximately 22 to 24 inches for an adult, is sufficient when positioned on the bed to extend from the user's mid-back to thighs.

Figure 5:
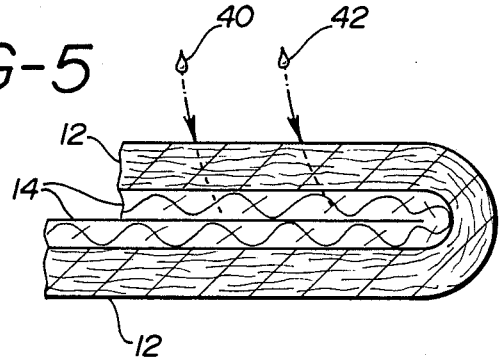
FIG. 5 is a partial sectional view of the embodiment of FIG. 2, taken along lines 5—5 of FIG. 4.

As depicted in FIG. 5, because of the porosity of the first fabric 12, water droplets, such as the user's sweat, 40 and 42, if they are not absorbed immediately by the first fabric, permeate the first fabric. They are posited on the tighter weave or surface of the second fabric 14 until eventually they are absorbed by the moisture absorbent, first fabric.

Figure 6:
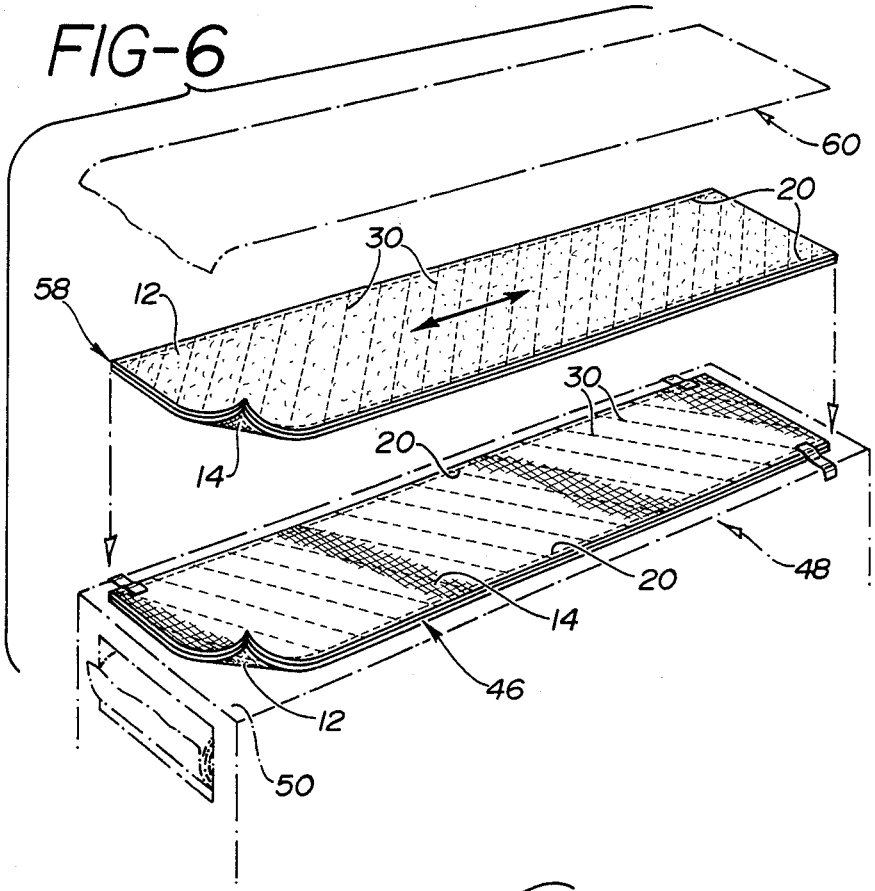
FIG. 6 is a perspective view of another embodiment of the invention.

A second embodiment of the present invention utilizes two combined fabric devices each comprising the first fabric secured to the second fabric. This second embodiment is found to be practical when used on the examining tables for obstetricians and gynecologists. In the following discussion identical reference numbers to those used to describe the embodiment of FIG. 2 are repeated for identical materials. In this embodiment, depicted in FIG. 6, a first combined fabric device 46 includes a first non-woven fabric 12 secured to a second woven, synthetic or plastic fabric 14. It is positioned on the examining table 48 with the first fabric material face down. Since the top surface 50 of the examining tables are vinyl or similar material, they tend to be relatively slippery. Therefore the first fabric device 46 is secured to the table top by adhesive tape or the like as shown at 52,54 and 56. A second fabric device 58 substantially identical to the first fabric device includes a non-woven third fabric 12 secured to a fourth fabric of woven synthetic material or plastic 14. It is positioned over the first fabric device 46 with the fourth fabric 14 of the second fabric device 58 face down and in contact with the second fabric 14 of the first fabric device 46. Typically the examining paper 60 is placed on top of the non-woven third fabric of the second fabric device 58. The patient then lies on the paper in a typical fashion but is now able to freely move along the length of the table thus facilitating the doctor's exam; as well as enhancing the overall comfort of the patient.

Figure 7:
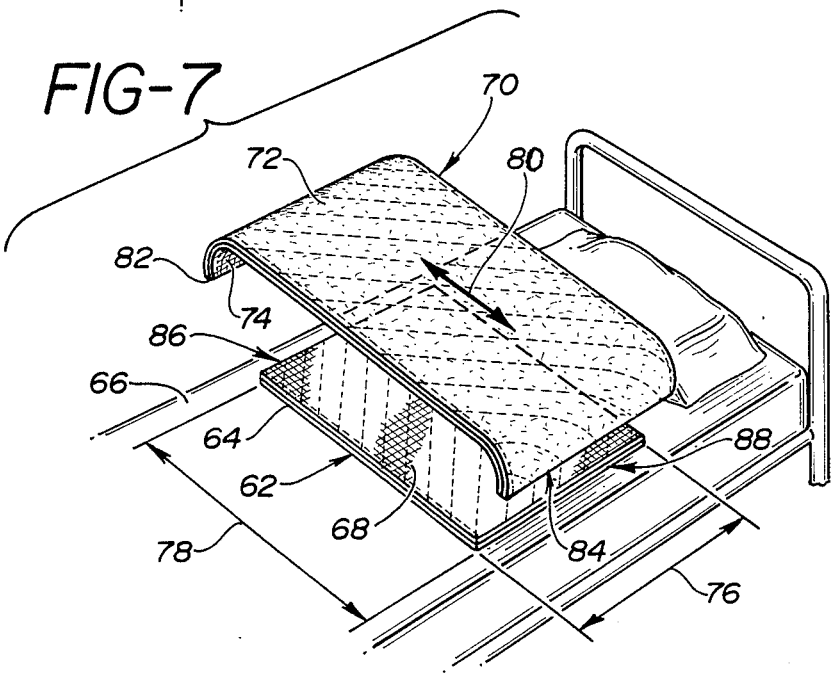
FIG. 7 is a perspective view of still another embodiment of the present invention.

Alternatively, the combined first and second fabric devices can be disposed transversely across a resting surface, such as the user's bed. This is depicted in FIG. 7. Here the first combined fabric device 62, is positioned on the bed with the first fabric 64 in contact with the top surface 66 of the bed, which is typically covered by a bed sheet. The second fabric 68 is, of course, facing upwards.

The second combined fabric device 70 includes a third fabric 72 and a fourth fabric 74. The second fabric device 70 is positioned on top of the first fabric device 62 such that the second and fourth fabrics, 68 and 74, are in contact with each other and are coextensive with each other along dimension 76 when first positioned one on top of the other.

The length 78 of the first fabric device 62 is somewhat wider than the user's body width. The length of the second fabric device 70 is longer than length 78 and typically might extend a few inches either side beyond the edge of the bed. The length of the second fabric device 70 should be such so as to permit the user to move in a rotating manner, from back to side to stomach such that movement of the device 70 in direction 80 leaves the edge 82 or 84 still extending beyond edges 86 and 88 respectively, of the first fabric device 70. The combined first and second fabric devices are initially positioned on the bed, under the patient so that the width (dimension 76) extends between the user's mid-back and thighs. Again this width 76 is approximately 22 to 24 inches when used with an adult.

If the contact surface between the top surface 66 and the fabric 64 is relatively slippery, the first fabric device 62 can be secured to the surface 66 by adhesive tape, pinning or other means.

The combined fabric device of the present invention as depicted in the various embodiments makes turning on a resting surface a great deal easier for persons disabled by surgery, back problems, arthritis, etc.

As the person turns in bed, often easily under their own power, the first or outer fabric of non-woven material clings to the patient's body or night clothes, and the bed sheet, while the second woven fabric slides on itself. This significantly reduces the patient effort necessary to turn the body.

In order to turn one's body with the present invention in place, whether it be the embodiment of FIG. 4 or FIG. 7, the user simply turns in a normal fashion. This would involve generally contacting the top surface 60 of the bed or resting place with one's heel or other part of the foot extending beyond the fabric devices, and/or the shoulder and head, while rotating the hips in the desired direction. The fabric device, 10 in FIG. 4, or 70 in FIG. 7, moves in direction 82 or 80. The particular lateral direction of the top portion of device 10 and the second fabric device 70, will depend on the rotational directions of the body. Because of the relatively frictionless contact between the coacting surfaces, e.g. the second and fourth fabrics, 68 and 74, the rotational movement is accomplished practically without effort and without any heightened pain in an afflicted user.

Figure 8:
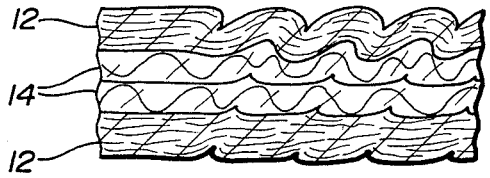
FIG. 8 depicts in elevational, sectional view of a feature of the present invention.

The combined fabric device is typically made of soft, non-woven material secured to the woven, relatively frictionless material. Both are paper thin, readily pliable and easily compacted as illustrated in FIG. 8. Thus, even if the fabric devices bunches up under the patient's body it can't be felt. Thus little, if any, discomfort results.

As noted above, a lower cost version would utilize a "slippery" plastic material for the second fabric. This again would be a thin sheet so as to provide the pliability and compactability desired. Also, again, in keeping with the invention, the plastic sheet material would be secured only at periodic intervals along the co-extensive surfaces between the two, or only along the edges. This will permit the first fabric to retain its permeability to air and water so that user comfort is enhanced.

Fabric devices of differing widths and lengths, of course, can be fabricated to handle different bed widths and patient sizes.

Of course, the fabric devices of the present invention can be used at home or anywhere as a facilitator in turning the body.

Other adaptations of the present invention will now be apparent in view of the above description.

The above should not be viewed as limiting the present invention whose breadth is to be defined by the scope of the following claims.

What is claimed is:

1. In combination with a bed, resting surface, or the like having a top surface, a combined fabric device useful in facilitating the movement of a person's body while lying on said combined fabric device disposed on said top surface comprising:

(a) a first fabric device including, (i) a first fabric made of a non-woven, paper thin, soft, pliable, compactable, porous material, said material being permeable to air and water and moisture absorbent, said material characterized in that it is non-irritating to the person's skin after laying on same for a prolonged period of time;

(ii) a second fabric made of a material which is relatively frictionless such that it moves relatively easily on itself, (iii) means fixedly securing said first fabric to said second fabric to form said first fabric device having a first and second end; and, (b) a second fabric device including, (i) a third fabric made of a non-woven, paper thin, soft, pliable, compactable, porous material, said material being permeable to air and water and moisture absorbent, said material characterized in that it is non-irritating to the person's skin after laying on same for a prolonged period of time;

(ii) a fourth fabric made of a material which is relatively frictionless such that it moves relatively easily on itself, (iii) means fixedly securing said third fabric to said fourth fabric to form said second fabric device having a first and second end, said first fabric device having a first length and width;

said first fabric device disposed on said top surface, such that its length extends transversely across said bed, and such that said second fabric is facing upward, said second fabric device having a second length and width, said second fabric device disposed along the length of said first fabric device, said fourth fabric contacting said second fabric, said third fabric facing upward toward the user, the widths of said first and second fabric devices coextensive with each other and extending along the length of the bed or resting surface, said coextending widths, when first positioned on said top surface beneath the user, extending the distance between the user's mid-back and thighs, whereby the user can use the extremities of his body, extending beyond the coextending first and second fabric devices, to contact the top surface of the bed or resting surface so as to initiate rotational turning of his hips which turning is facilitated by the relatively frictionless contact between said second fabric and said fourth fabric.

2. In combination with a bed, resting surface, or the like having a top surface, a combined fabric device useful in facilitating the movement of a person's body while lying on said combined fabric device disposed on said top surface comprising:

(a) a first fabric made from a non-woven, paper thin, soft, pliable, compactable, porous material, said material being permeable to air and water and moisture absorbent, said material characterized in that it is non-irritating to the person's skin after laying on same for a prolonged period of time;

(b) a second fabric made from a material which is relatively frictionless such that it moves relatively easily on itself;

(c) means fixedly securing said first fabric to said second fabric to form a first subassembly having a first and second end; and (d) means connecting said first end to said second end to form a closed loop of said first subassembly such that said second fabric is on the interior side of said closed loop whereupon it can slide on itself, said closed loop of said first subassembly having a width approximately equal to the width of the bed and having a length approximately extending the distance between the person's mid-back and thighs, said fabric device when interposed between a person and said top surface upon which he reclines and when disposed between that person's thighs and mid-back, facilitating that person's ability to turn and move under his own power without the aid of a second person, the person's comfort not disturbed by laying thereon for a prolonged period of time, even though the fabric device may be bunched beneath him, due in part to the non-woven, paper thin, soft, pliable, porous, air and water permeable, moisture absorbent material comprising said first fabric.

3. In combination with a physician's examining table, said examining table having a top surface, a fabric device comprising:

(a) a first fabric device including, (i) a first fabric made of a non-woven, paper thin, soft, pliable, compactable, porous material, said material being permeable to air and water and moisture absorbent, said material characterized in that it is non-irritating to the person's skin after laying on same for a prolonged period of time, (ii) a second fabric made of a material which is relatively frictionless such that it moves relatively easily on itself, (iii) means fixedly securing said first fabric to said second fabric to form said first fabric device having a first and second end; and, (b) a second fabric device including, (i) a third fabric made of a non-woven, paper thin, soft, pliable, compactable, porous material, said material being permeable to air and water and moisture absorbent, said material characterized in that it is non-irritating to the person's skin after laying on same for a prolonged period of time;

(ii) a fourth fabric made of a material which is relatively frictionless such that it moves relatively easily on itself, (iii) means fixedly securing said third fabric to said fourth fabric to form said second fabric device having a first and second end, said first fabric device having a first length and width;

said first fabric device disposed on said top surface, such that its length extends along the length of said physician's examining table, and such that said second fabric is facing upward, said first fabric device fixedly secured to said top surface, said second fabric device having a second length and width, said second fabric device disposed along the length of said first fabric device, said fourth fabric contacting said second fabric, said third fabric facing upward toward the patient, whereupon movement of the patient, disposed upon said third fabric, along the length of the table is facilitated by the relatively frictionless contact between said second fabric and said fourth fabric.

4. The combination claimed in either claim 1, 2 or claim 3 wherein said second and fourth fabric is made from a woven material.

5. The combination claimed in claim 4 wherein the woof of the weave of said woven material forming said second and fourth material extends in a direction from said first end to said second end.

6. The combination claimed in either claim 1, 2, or 3 wherein said second and fourth fabric is made from a smooth plastic sheet material.

7. The combination claimed in either claim 1, 2, or claim 3 wherein the shape of said first, second, third, and fourth fabric is rectangular, said means for fixedly securing said first fabric to said second fabric and said third fabric to said fourth fabric includes a plurality of stitchings.

8. The combination claimed in claim 3 further comprising examining table paper interposed between the patient and the third fabric.

9. The combination claimed in claim 1 wherein the length of said second fabric device extends beyond the first and second end of said first fabric device.

10. The combination claimed in claim 1 wherein said first fabric device is fixedly secured to said top surface.

* * * * *